US007418740B2

(12) United States Patent
Anderson et al.

(10) Patent No.: US 7,418,740 B2
(45) Date of Patent: Sep. 2, 2008

(54) HEAD AND FACE PROTECTOR

(75) Inventors: Seth I. Anderson, Grand Junction, CO (US); Douglas D. Anderson, Grand Junction, CO (US)

(73) Assignee: LOKI, LLC, Grand Junction, CO (US)

( * ) Notice: Subject to any disclaimer, the term of this patent is extended or adjusted under 35 U.S.C. 154(b) by 72 days.

(21) Appl. No.: 11/281,045

(22) Filed: Nov. 16, 2005

(65) Prior Publication Data

US 2006/0075538 A1 Apr. 13, 2006

Related U.S. Application Data

(63) Continuation-in-part of application No. 10/079,118, filed on Feb. 20, 2002, now Pat. No. 6,996,847.

(51) Int. Cl.
*A41D 13/00* (2006.01)

(52) U.S. Cl. ..... 2/69

(58) Field of Classification Search ..... 2/173, 2/202, 206, 171, 209.3, 209.11, 114, 115, 2/84, 108, 207, 181.4

See application file for complete search history.

(56) References Cited

U.S. PATENT DOCUMENTS

| | | | | |
|---|---|---|---|---|
| 3,561,010 | A * | 2/1971 | Little | 2/173 |
| 5,546,604 | A * | 8/1996 | Geller | 2/202 |
| 5,713,077 | A * | 2/1998 | Humbrecht | 2/173 |
| 5,765,230 | A | 6/1998 | Sivret et al. | |
| 5,845,340 | A * | 12/1998 | Frislie | 2/202 |
| 6,272,690 | B1 | 8/2001 | Carey et al. | |
| 6,397,395 | B1 * | 6/2002 | DeHart | 2/206 |
| 6,675,394 | B2 * | 1/2004 | Egnew | 2/227 |

* cited by examiner

*Primary Examiner*—Tejash Patel
(74) *Attorney, Agent, or Firm*—Allen H. Erickson

(57) ABSTRACT

A versatile upper body garment formed of a stretchable fabric is configured to provide a variety of modes of wear with respect to head covering. A coat, jacket, shirt or vest has an integral hood which covers the wearer's head. Within the hood is an integral face shield which may be swung behind the wearer's head or neck when not covering the face, enabling protection of various portions of the face. The hood may be tightened to expose a variable extent of the head or face. The hood and face shield may be configured to be rolled into a hollow collar for storage when not needed.

9 Claims, 6 Drawing Sheets

HEAD AND FACE PROTECTOR

This is a continuation-in-part of application Ser. No. 10/079,118 filed Feb. 20, 2002 now U.S. Pat. No. 6,996,847.

BACKGROUND OF THE INVENTION

1. Field of the Invention

The present invention relates to upper body garments. More specifically, the invention relates to multifunctional garments which may be worn in a variety of different modes to accommodate a wide range of atmospheric conditions and activities of the wearer. The invention more particularly pertains to coats, jackets, vests or shirts, with appurtenances thereto particularly addressing headwear for cold weather conditions.

2. State of the Art

The need for warm upper body garments, e.g. coats and jackets, has always been important for humanity. In regions which experience cold temperatures, it has been found that heat transfer from a person's head and extremities, e.g. arms and legs (particularly the hands and feet) is most critical. This is because the ratio of surface area to mass is highest in these areas, and human activity is often predicated upon having at least a portion of the head and hands being exposed, i.e. uncovered at times. This is true of many outdoor winter activities which are becoming very popular, such as skiing, ski-touring, ice climbing, mountain climbing, rock climbing, ice sailing, skating, ice fishing, hunting, snowmobiling, snowshoeing, winter camping and the like.

In cold-weather use of an upper body garment such as a jacket or coat, heat transfer from a wearer's body typically occurs in several specific areas. First, there is general heat transfer through the body and arms of the garment. This heat loss may be controlled by varying the insulative value of the coat material, and/or as commonly practiced, by layering of shirts, sweaters, etc. under the outer garment. Secondly, there is heat loss by movement of air through the space between the lower extremity of the coat and the person's waist. This heat loss may be controlled by varying the tightness of the coat about the person's waist. Thirdly, there is heat loss from exposure of the wearer's head, which in many cases is the major source of heat loss from a wearer's upper body. Control of the head area which is exposed, and varying the insulative properties of the head covering, are two methods used to effect a desired head temperature. Fourthly, heat transfer from the hands and lower arms is also very important but is not addressed herein.

Several patents relating to head coverings are known to the applicant:

In U.S. Pat. No. 5,765,230 to Sivret et al., a head apparel is shown as a tubular hood configured so that a bottom portion may be rolled up inside the upper portion to become a face covering. Alternatively, the user's face may be projected through a face opening and the apparel placed on the shoulders.

In U.S. Pat. No. 6,272,690 to Carey et al., a head covering includes a neoprene mask member with holes for breathing. Goggles may be fitted to complete substantial covering of the user's head, face and neck.

Neither of the references shows a garment hood in which a face shield may be retracted without changing the overall dimensions of the hood. Furthermore, none of the references show an attached face shield which may be rolled into a collar and concealed together with a hood.

BRIEF SUMMARY OF THE INVENTION

The present invention is, in one embodiment, an upper body garment such as a jacket, coat, shirt or vest configured for cold-weather use where large temperature variations may be encountered. The garment integrally includes or is configured for use with particular headwear and/or handwear, each of which is uniquely designed to be used in a variety of ways to achieve a desired combination of warmth, comfort and dexterity. The torso portion, arms and head covering of the garment may be formed of materials which have the appropriate strength, insulation value, water resistance, stretchability and appearance. The head covering portion may be formed of a pliable material, preferably a stretchable fabric such as a fleece, a hard-surfaced fleece, in combination with a lightweight "shell" type material such as made of polytetrafluoroethylene (PTFE) such as are available under the trademark GORTEX®. A variety of other fabrics may also be used, at least a portion of which must have high 2-way or 4-way stretch properties. The head covering and hand coverings of the invention may be combined in various configurations in combination with various garment types, i.e. coat, jacket, shirt, vest, vest with attachable/detachable arms, etc.

The head covering of the garment is a hood which is integrally formed with the torso portion. When fully deployed, the hood covers the wearers head surrounding the face. The hood edge at the face opening may include a channel encircling the wearer's face. A draw-string with terminal cinch devices may be carried in the channel for tightening the hood fabric about the face. In addition, in one embodiment, the hood includes an abbreviated brim for shading the wearer's eyes.

A particular feature of the hood is a soft porous face shield which is attached at each end to the inside of the hood. The face shield may be alternatively worn over the wearer's lower face, adjustable to cover and insulate either (a) the nose, mouth and neck, (b) the mouth and neck, or (c) the wearer's neck. When not used to cover the face, nose, mouth and/or neck, the face shield may be positioned behind the wearer's head or neck. Whether the hood is worn to cover the head, or pulled downward to form a "collar" about the neck (under the chin), the face shield may be usefully used to cover a portion of the face or neck. The face shield may be formed as a permanent part of the hood, or may be configured to be removably attached, as for example with Velcro™ pads, zippers, and the like. The face shield may be formed with a screen panel through which the wearer may breathe, minimizing condensation on the face shield.

In one version of the garment, a jacket has a circumferential hollow collar into which the attached hood may be rolled and concealed. In an embodiment of the present invention, a face shield is attached within a concealable hood whereby upper portions of the lateral edges are joined to the interior back of the hood and the lower corner of each lateral edge is detachably attached to the jacket's collar. Thus, the face shield may be rolled into the hollow collar together with the hood.

The face shield is formed of a fabric which is insulative and permits passage of inhalant and exhalant gases at a relatively low pressure drop. The garment including body, hood, arm portions and hand coverings may be formed of a variety of materials, such as artificial fleece, hard-faced fleece, shell material such as known as Gortex© and other materials, with certain elements such as the face shield, i.e face protector, made of materials with a high degree of elasticity or stretchability in two axes.

The various combinations of features provide enhanced versatility to the garment, enable a wearer to adapt the hand coverings and head covering to a wide variety of atmospheric conditions (temperature, wind, precipitation, etc.) and degree of physical exertion, without requiring removal or attachment of a separate headwear unit and/or separate handwear units. The versatile garment of the invention is particularly useful when participating in strenuous or dangerous sports, permitting adjustment of hand/finger dexterity and thermal coverage of hands/face during the participation. Loss of garment items under high stress conditions is eliminated or reduced, and wearer comfort is maintained at all times.

BRIEF DESCRIPTION OF THE SEVERAL VIEWS OF THE DRAWINGS

The nature of the present invention as well as other embodiments thereof may be more clearly understood by reference to the following detailed description of the invention, to the appended claims, and to the several drawings herein, wherein:

DETAILED DESCRIPTION OF THE INVENTION

Figure 1:
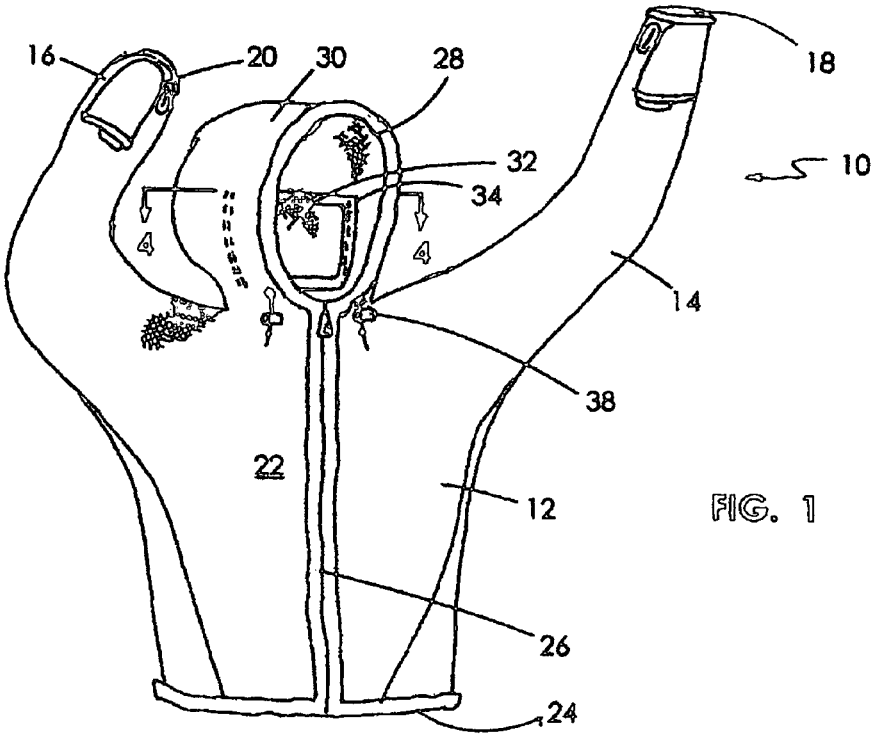
FIG. 1 is a general frontal view of a first exemplary embodiment of a garment in a closed position with head covering in accordance with the invention.

In use and operation, and referring to FIG. 1, a first exemplary embodiment of garment 10 of the invention is depicted as a coat or jacket. As shown, the garment 10 includes a torso portion 12 with integral arm portions 14 and an integral head covering 30 comprising a hood. Each arm portion 14 comprises a tube extending from the torso portion 12 to a lower sleeve portion 16, shown with a terminal hand covering comprising an integral mitten 20. The mitten 20 is shown with a terminal opening 18 through which a user's hand may be extended.

As shown in FIG. 1, the exemplary garment 10 has a front portion 22 with a zipper 26 which extends from the lower garment edge 24 to opening 28 in the head covering (hood) 30. The head covering 30 may be fitted with a circumferential cinch cord or drawstring 38 for tightening about the wearer's head. A face shield 32 comprises an elongate insulative member with each end 34 attached (fixedly or temporarily) to the inside of the head covering 30. It will be described in more detail, infra.

Figure 2:
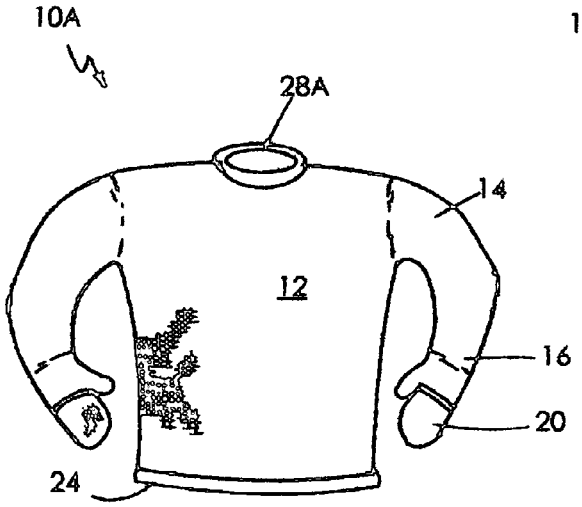
FIG. 2 is a general frontal view of a second exemplary embodiment of a garment with versatile mittens in accordance with the present invention.

FIG. 2 depicts a second exemplary garment 10A such as a shirt, sweater or sweatshirt. The garment 10A is shown with a torso portion 12 with lower edge 24, and a head opening 28A. The garment 10A is shown without a head covering 30 and torso zipper 26, but with hand coverings 20 at lower sleeve portions 16 of arms 14. A head covering according to the invention may be configured to be mountable on garment 10A.

Figure 3:
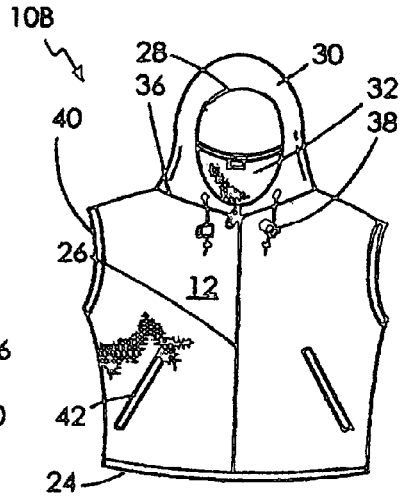
FIG. 3 is a general frontal view of a third exemplary embodiment of a garment with a head covering in accordance with the invention.

In FIG. 3, another embodiment of the invention is shown as a vest type garment 10B comprising a torso portion 12 with lower edge 24. An integral head covering 30 is joined to the torso portion 12 along seams 36, and is shown as a hood with a manipulable face shield 32. The head covering 30 has an opening 28, about which a cinch cord 38 is used to tighten the covering over a wearer's head. The garment 10B is also shown with exemplary front zipper 26, arm openings 40, and pockets 42.

Figure 4:
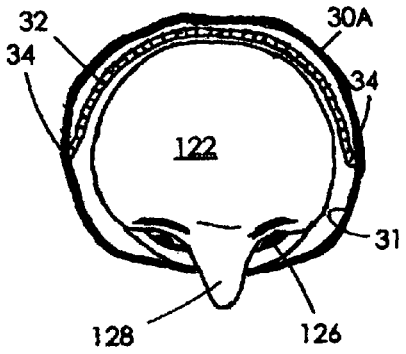
FIG. 4 is cross-sectional view through a head covering of the invention in a storage mode, as taken along line 4-4 of FIG. 1.
Figure 5:
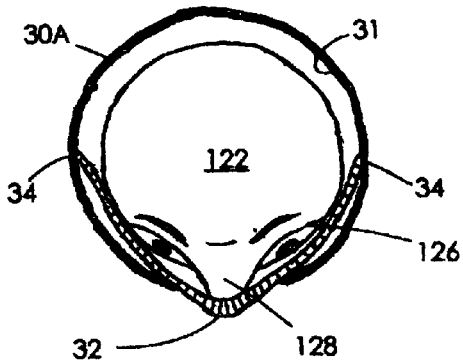
FIG. 5 is a cross-sectional view through a head covering of the invention in a face covering mode, as taken along line 4-4 of FIG. 1.

Turning now to the head covering 30 of the invention, the sectional views of FIGS. 4 and 5 show the head covering as a hood 30A in which an insulative face shield (face protector) 32 having ends 34 attached in generally vertical directions to the hood interior 31 on each side of the wearer's head 122. In FIG. 4, the face shield 32 is positioned behind the wearer's head 122 to leave the wearer's nose 128 and face 128 exposed. In this mode, the face shield 32 provides insulative value to the back of the wearer's head 122.

In FIG. 5, the face shield 32 is positioned to cover significant portions of the wearer's face 128, including a portion of the nose 128. The face shield 32 is formed of a stretchable material so that it may be adjusted to cover the nose, mouth, face, chin and/or neck. A tab 138 may be attached to the face shield 32 for finger manipulation to the most desirable position.

Figure 6:
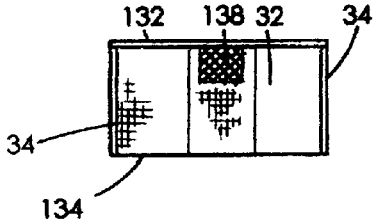
FIG. 6 is a plan view of a face shield of the invention.
Figure 16:
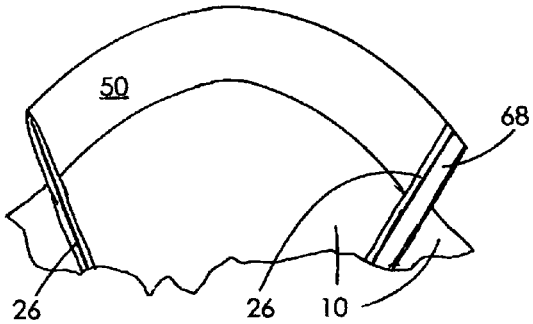
FIG. 16 is a general frontal view of a jacket collar into which a hood and face shield of the invention are rolled up within the collar, in accordance with the invention.
Figure 17:
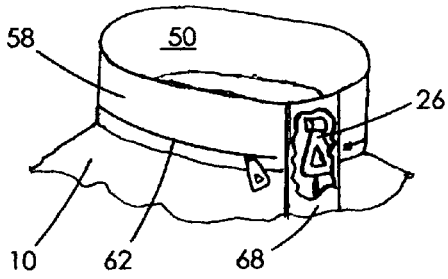
FIG. 17 is a general side view of a jacket collar into which a hood and face shield of the invention are rolled up within the collar, in accordance with the invention.

As depicted in FIG. 6, the face shield 32 is typically formed of a roughly rectangular panel of insulative stretchable (pliable) material such as an insulative fabric, including and has an upper edge 132, lower edge 134, and ends 34. A central portion 48 of the shield 32 may optionally be formed of a porous screening or similar material, and is located in the vicinity of the nose and/or mouth to permit heavy breathing by the wearer without saturating the shield with moisture. The ends 34 may be sewn to the inside 31 of hood 30 or joined by other methods, for example by the use of hook and loop strips, such as available under the trademark Velcro®. In the latter case, the face shield 32 may be easily removed for cleaning or replacement.

Figure 7:
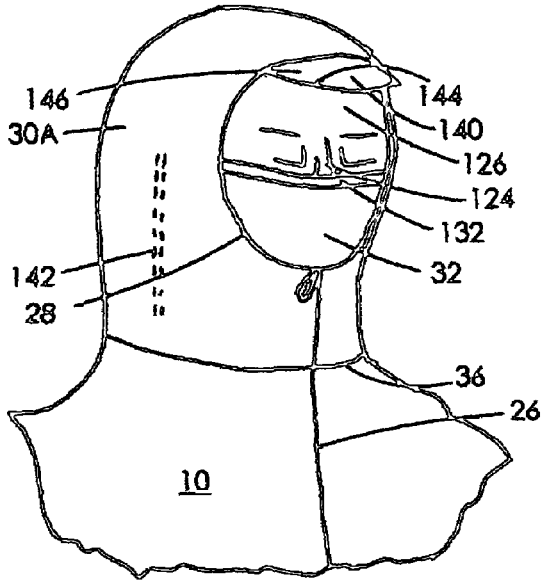
FIG. 7 is a general frontal view of an exemplary head covering of a garment of the invention in a first mode of wear.

Various modes of wearing the head covering 30A are illustrated in FIGS. 7, 8, 9, 10, and 11 to achieve varying degrees of weather protection, including warmth. As shown in FIG. 7, garment 10 includes a hood 30A joined to the garment along seam 36, and has an opening 28 for face exposure. A face shield 32 is shown as overlying a lower portion of face 126 from the nose 124 downward. Sew lines 142 by which the shield ends 34 are attached to the hood 30A are shown. In addition, an abbreviated brim or bill 140 is shown as formed along an upper edge of opening 28, for shielding a wearer from sunlight or precipitation. The brim 140 may be formed of an interior shape-retaining member 144 with an outer water-resistant material 146. The brim 140 is configured to extend outward from the opening 28 a maximum of about 0.75 inch to about 2 inches. A zipper 26 or other opening device enables opening of the garment. Preferably, placement of zipper 26 is such that when the garment 10 is closed, the zipper is substantially covered and not visible.

Figure 8:
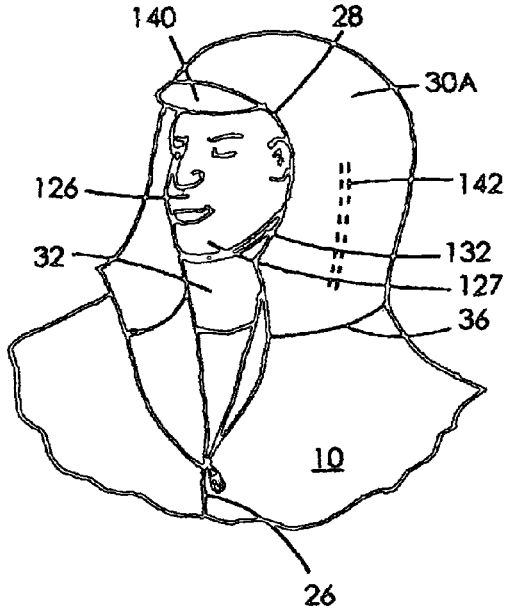
FIG. 8 is a general frontal view of an exemplary head covering of a garment of the invention in a second mode of wear.

As shown in FIG. 8, a wearer's face 126 may be exposed by pulling the face shield 32 downward to below the chin 127, in which case the face shield 32 covers the frontal portion of the neck 121 (see FIG. 9). Zipper 26 may be partially opened for further air circulation, as shown.

Figure 9:
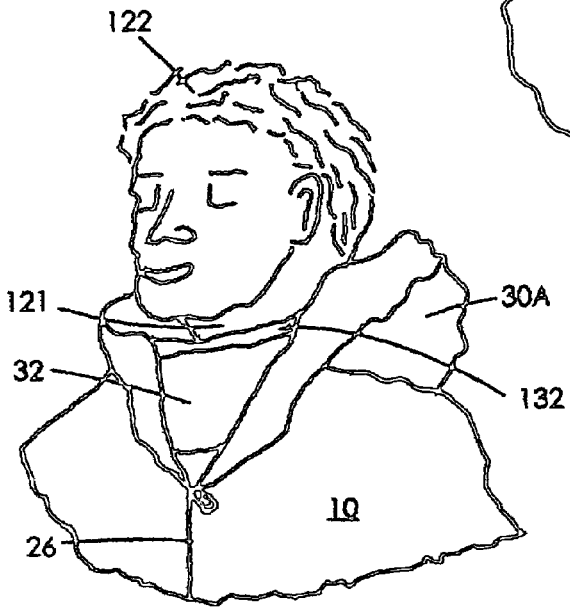
FIG. 9 is a general frontal view of an exemplary head covering of a garment of the invention in a third mode of wear.

FIG. 9 shows a wearer's head 122 from which the hood 30A has been drawn downwardly. Even in this position, and despite opening of an upper portion of garment 10, the face shield 32 will retain its position to insulate the front of the wearer's neck 121.

Figure 10:
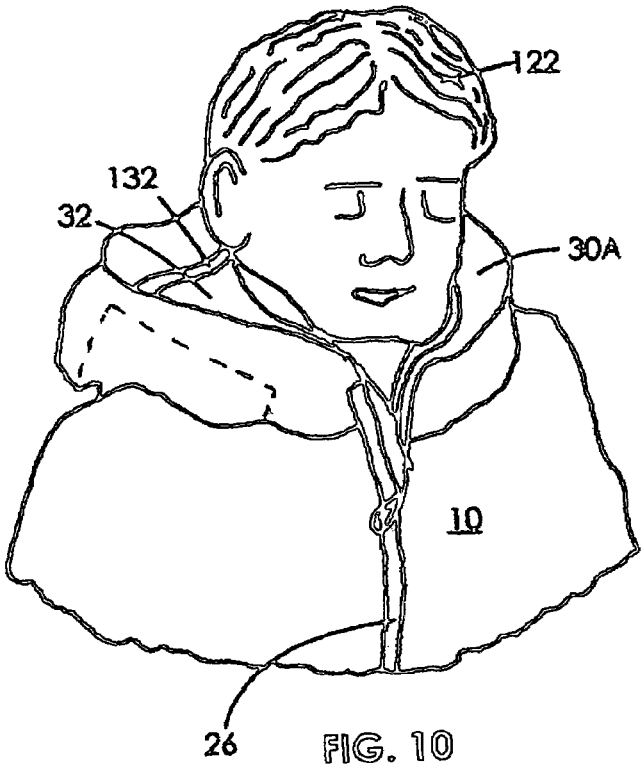
FIG. 10 is a general frontal view of an exemplary head covering of a garment of the invention in a fourth mode of wear.

FIG. 10 illustrates a wearing mode wherein the wearer's head 122 is placed in front of the face shield 32. In this configuration the wearer's head 122, face 126 and frontal portions of the neck 121 are fully exposed.

Figure 11:
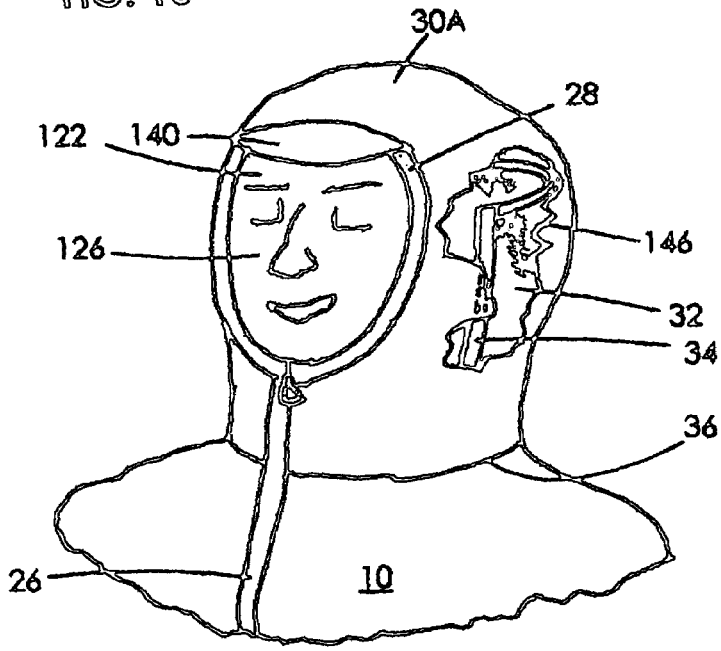
FIG. 11 is a general frontal view of an exemplary head covering of a garment of the invention in a fifth mode of wear.

FIG. 11 depicts a wearing mode in which the garment 10 is closed, but the face shield 32, visible in cutaway 146, is positioned behind the head 122, leaving the wearer's face 126 uncovered.

FIGS. 12 through 17 illustrate embodiments of the invention whereby a head covering 30, including the face shield 32 may be rolled downward into the hollow collar 50 of the garment 10.

Figure 12:
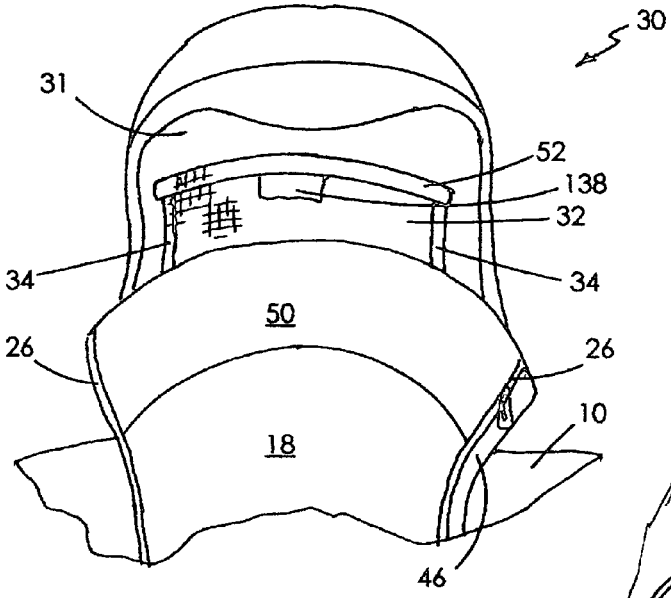
FIG. 12 is a frontal view of a head covering of the invention for a collared jacket.
Figure 13A:
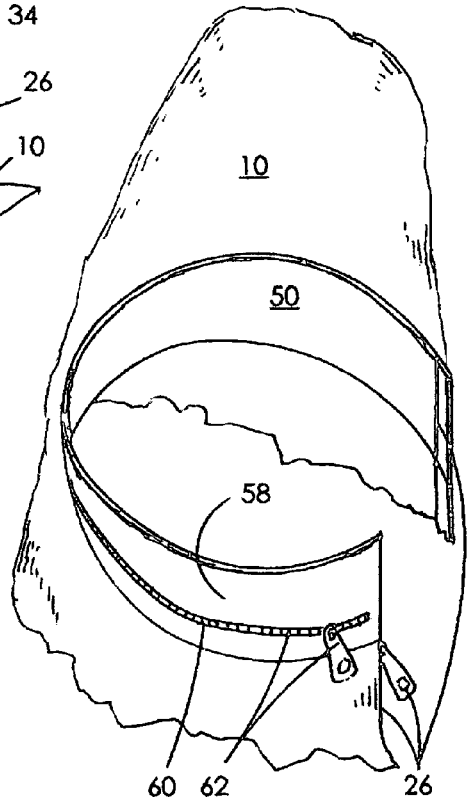
FIG. 13A is a perspective view of the backside of a hollow collar for storing a head and face protector of the invention.
Figure 13:
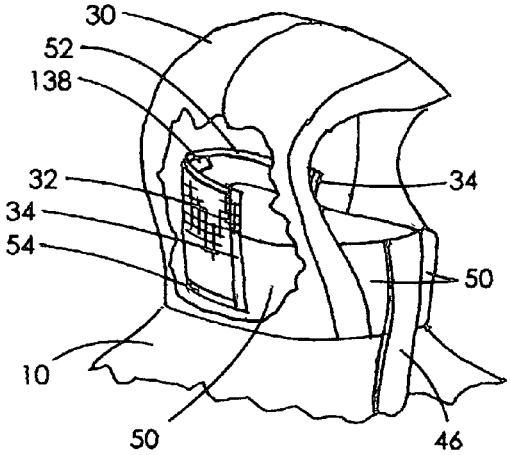
FIG. 13 is a general side view, partially cut-away, of a head covering of the invention for a collared jacket.

As shown in FIGS. 12 and 13, when the embodiments described thus far are to be applied to a collared jacket 10, the face shield 32, attached to the hood interior 31 along opposed ends 34, will in an unused mode be behind the hollow collar 50. The face shield 32 may be easily moved to the front of the wearer's face 126 by pulling it over the collar 50. The hood 30 including face shield 32 may be inserted in a circumferential opening 60 (see FIG. 13A) in the back side 58 of hollow collar 50, which is closeable by for example zipper 62. The lower edge of the hood 30 is attached to the torso portion 12 of garment 10 within the hollow collar 50. Thus, the hood 30 and face shield 32 will be totally hidden from view when rolled into the collar 50, which is closed by zipper 62. As shown in FIG. 13, the garment 10 may include a zipper cover 46 adjacent the garment's zipper 26.

Figure 14:
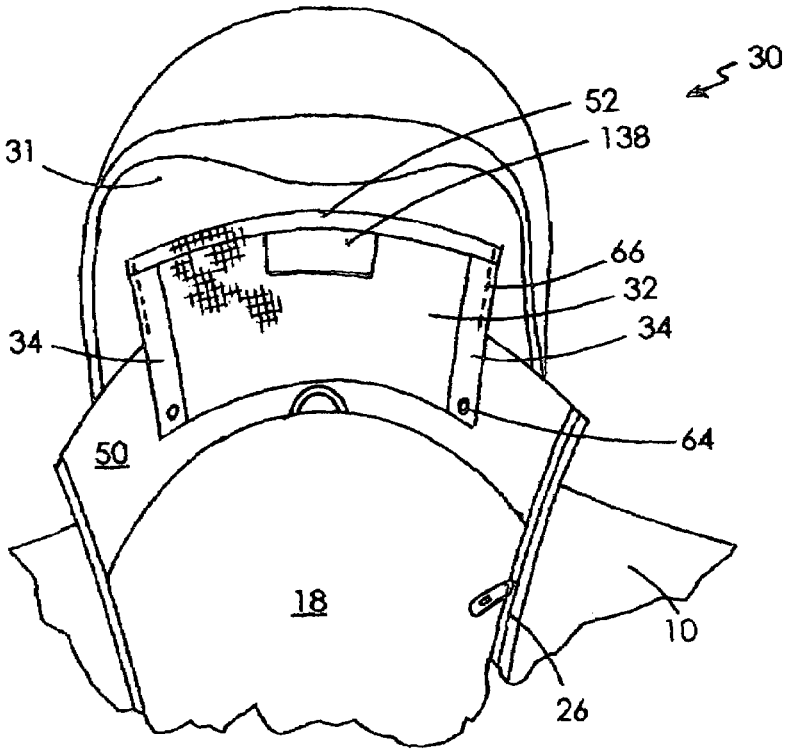
FIG. 14 is a frontal view of another embodiment of head covering of the invention for a collared jacket.
Figure 15:
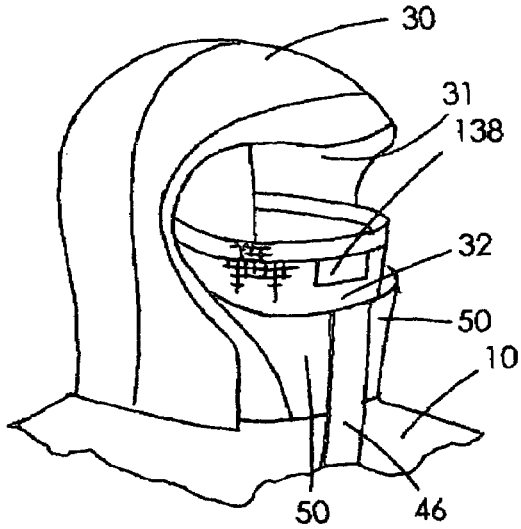
FIG. 15 is a general side view of another embodiment of head covering of the invention for a collared jacket.

In the embodiment of FIGS. 14 and 15, the face shield 32 is attached to the hood interior 31 differently. The upper portions of the ends 34 are attached to the hood inside 31 by for example, sewing 66. The lower portions of the ends 34 of face shield 32 are detachably attached to the inside surface 56 of collar 50 by snaps 64, hook and loop material, or other attachment means known in the art. In this embodiment, the face shield 32 is inside of the collar 50 when in use. Thus, it provides improved heat retention in the neck area, as seen in FIG. 15. The face shield 32 and hood 30 may be rolled up through opening 60 in the backside 58 of the collar 50, simply by unsnapping the lower snaps 64 and rolling the hood 30 downward.

The variety of garment configuration described herein enable a desirable comfort level under widely ranging climatic conditions and activities. Each of the head coverings has various modes of wear whereby rapid changes in temperature, wind speed, or personal activity level may be accommodated rapidly and easily. Such changes may be made "on the run", i.e. without long pauses in activity.

It will be recognized from the above description that the various garment configurations of this invention enable a wearer to perform strenuous activities in greater comfort, safety and enjoyment than was previously attainable.

While the present invention has been disclosed herein in terms of certain exemplary embodiments, those of ordinary skill in the art will recognize and appreciate that it is not so limited. Many additions, deletions and modifications to the disclosed embodiments may be effected without departing from the scope of the invention. Moreover, features from one embodiment may be combined with features from other embodiments. The scope of the instant invention is only to be limited by the claims which follow.

What is claimed is:

1. A versatile multi-mode upper body garment in consisting of:

a torso portion;

two arm portions integrally attached to said torso portion;

a hood integral with said torso portion between said arm portions, said hood having an interior surface with a face opening;

a face covering having two opposed ends, an upper edge and a lower edge, one of said opposed ends mounted in a generally vertical position on the left side of said interior surface, and the other of said opposed ends mounted in a generally vertical position on the right side of said interior surface, wherein said upper edge and said lower edge are free from attachment to said interior surface;

whereby said face covering is movable between a frontal position wherein a portion of said person's face is covered and a back position adjacent the back of said person's head;

wherein said face covering is formed of a fabric stretchable along two axes whereby said face covering is mode-adjustable to be movable between a position (a) covering the person's nose, (b) covering the person's mouth, (c) covering the person's chin, (d) covering the person's front neck portion below the nose, and (e) covering the back of said person's head; and further consisting of a mesh panel in a central portion of said face covering, said mesh panel configured to be proximate said person's nostrils and mouth for ease of breathing without saturating said face with breath moisture.

2. A versatile multi-mode upper body garment in accordance with claim 1, wherein said mesh panel is removably attached to said face covering.

3. A versatile multi-mode upper body garment in accordance with claim 1, wherein said face covering is fixedly attached to said interior surface of said hood.

4. A versatile multi-mode upper body garment in accordance with claim 1, wherein said face covering is removably attached to said interior surface of said hood by attachment means.

5. A versatile multi-mode upper body garment in accordance with claim 4, wherein said attachment means comprises at least one of snaps and hook-and-loop materials.

6. A versatile multi-mode upper body garment in accordance with claim 1, wherein said mesh panel is removably attached to said face covering.

7. A versatile multi-mode upper body garment in accordance with claim 1, further comprising:

a jacket collar inside of said head covering with a hollow space therein;

a circumferential opening on the outside surface of said hollow jacket collar providing access to said hollow space; and closure means for closing said circumferential opening;

wherein said head covering is attached to said collar within said hollow space; and wherein said head covering and face covering are rollable downwardly to be enclosed within said hollow space.

8. A versatile multi-mode upper body garment in accordance with claim 7, wherein said closure means comprises a zipper.

9. A versatile multi-mode upper body garment in accordance with claim 7, wherein said ends of said face covering have upper portions attached to said interior surface of said hood and lower portions detachably attached to the inside surface of said collar.

* * * * *